US006474833B1

(12) United States Patent
Parsons et al.

(10) Patent No.: US 6,474,833 B1
(45) Date of Patent: Nov. 5, 2002

(54) DUAL SWITCH FLASHLIGHT

(75) Inventors: Kevin L. Parsons, Appleton, WI (US); W. Clay Reeves, Dallas, TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 09/513,731

(22) Filed: Feb. 14, 2000

(51) Int. Cl.[7] ..... F21L 4/04

(52) U.S. Cl. ..... 362/205; 362/206; 362/802; 200/60

(58) Field of Search ..... 362/205, 206, 362/802; 200/60, 51 LM, 332.02

(56) References Cited

U.S. PATENT DOCUMENTS 4,823,242 A 4/1989 Maglica et al.
5,138,538 A * 8/1992 Sperling ..... 362/205
6,045,237 A * 4/2000 Parsons et al. ..... 362/205

* cited by examiner

*Primary Examiner*—Sandra O'Shea
*Assistant Examiner*—Guiyoung Lee
(74) *Attorney, Agent, or Firm*—Welsh & Katz, Ltd.

(57) ABSTRACT

The present invention provides a flashlight having two switches, an on-off switch and an intermittent switch. The on-off switch allows the flashlight to be placed in either the on position or the off position. The intermittent switch allows the flashlight to be in the on position only when the switch is depressed and manually held down by the user. The presence of both switches provides the user with the flexibility of using the flashlight in either the on/off mode or the intermittent mode.

21 Claims, 6 Drawing Sheets

DUAL SWITCH FLASHLIGHT

FIELD OF THE INVENTION

This invention relates to flashlights and, more particularly, to flashlights having switches to control the operation of the flashlight lamp.

BACKGROUND OF THE INVENTION

Commercially available flashlights utilize a variety of switches to control the operation of the flashlight lamp. One type of switch is the push button on/off or latching switch that can be activated to open and close a circuit. To operate such a switch, the push button is depressed to close the circuit and place the lamp in its "on" position. The push button is then depressed again to open the circuit and place the lamp in its "off" position. The benefit of such a switch is that the lamp remains in the chosen position, either on or off, until the push button is again depressed. Thus, a continuous light beam can be obtained, without having to continually depress the push button. A disadvantage associated with such a switch is that it does not facilitate the intermittent use of the flashlight.

Another type of switch is a push button intermittent, or "deadman," switch, also known as a momentary switch. With such a switch, electrical contact is only maintained when the switch is depressed and manually held down by the user. Upon the release of the button, the electrical circuit is interrupted. Thus, if the flashlight falls from the user's hand, pressure on the switch is removed, the circuit is broken, and the light beam is extinguished. The use of a flashlight with a "deadman" switch can be extremely important to law enforcement agents in certain tactical situations. For example, if during pursuit of a suspect a police officer becomes injured or incapacitated in such a way as to drop his or her flashlight, the use of a "deadman" switch will cause the light beam of the flashlight to extinguish, preventing the flashlight from illuminating the fallen officer and thus a suspect from ascertaining the officer's location.

Another common use of a "deadman" switch is to permit intermittent use of a flashlight, such as for signalling purposes. One drawback to the "deadman" switch is that a user cannot place the flashlight in the "on" position or the "off" position, when desired. Thus, if an officer wants to investigate an area, he must keep the switch continually depressed to illuminate the area.

Flashlights having either an on/off switch or a "deadman" switch provide a user with only one option for controlling the operation of the flashlight lamp. This arrangement is less than ideal in a panic situation during which a user must turn a flashlight either on or off very quickly. During a panic situation, a user oftentimes loses his fine motor skills and thus is incapable of accomplishing tasks that involve much concentration or thought. Left with only gross motor skills, it is difficult for the user to locate and activate that single switch.

Further, there is a known flashlight that has a single switch, which is a combination on/off switch and "deadman" switch. When the switch is fully depressed, the switch functions as an on/off switch. However, if the switch is depressed partially, the switch functions as a "deadman" switch. To actuate this flashlight as desired requires the user to employ fine motor skills. As can be readily understood, a user in a panic situation could very easily actuate the flashlight in a manner that was not intended.

Thus, there is a need in the art to provide a flashlight having both an on-off switch and an intermittent switch.

Such a flashlight has separate and distinct switches having separate and distinct functions at separate and distinct locations.

SUMMARY OF THE INVENTION

The present invention provides a flashlight having two switches, an on-off switch and an intermittent switch. The on-off switch allows the flashlight to be placed in either the on position or the off position. The intermittent switch allows the flashlight to be in the on position only when the switch is depressed and manually held down by the user. The presence of both switches provides the user with the flexibility of using the flashlight in either the on/off mode or the intermittent mode.

The present invention further provides a flashlight having an on-off switch and an intermittent switch in close proximity to one another. In the present invention, the switches are provided on the endcap of the flashlight. Thus, while grabbing the flashlight in the "overhand" position, the user can conveniently activate either switch.

In a panic situation, the present invention provides the user with two options for activating the flashlight. Thus, the chances of the user activating the flashlight as desired are doubled as a result of the presence of the two push button switches.

Further, the present invention allows the customer to determine the location of the on-off switch and the intermittent switch. Thus, the flashlight can be customized according to the customer's needs.

DETAILED DESCRIPTION OF THE INVENTION

As used herein, "electrically connected" means connected via an electrically conductive pathway comprising one or more passive components. Thus, when two components are electrically connected, current may be able to flow between them, provided that a voltage having the correct polarity is applied between them.

Figure 1:
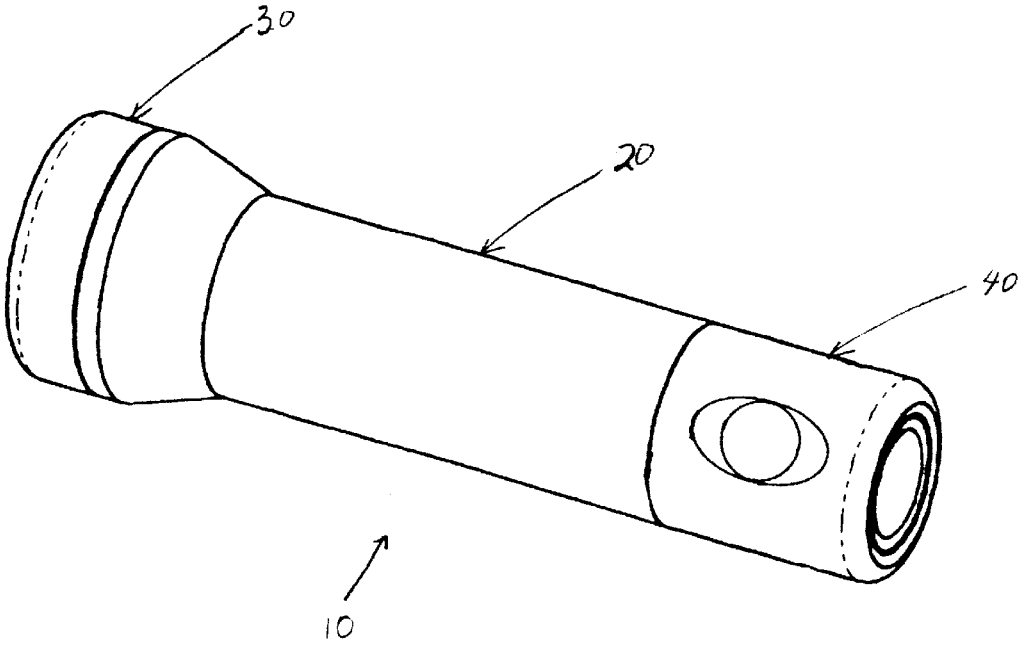
FIG. 1 is a perspective view of a flashlight made in accordance with the present invention.

A flashlight made in accordance with the present invention is depicted in FIGS. 1–14. As can be seen in FIG. 1, the flashlight 10 is generally comprised of a flashlight body 20, a head assembly 30 and a switch assembly 40. With respect to the details of the flashlight body 20 and the head assembly 30, U.S. patent application Ser. No. 08/738,858, filed on Oct. 28, 1996 for a "Tactical Flashlight," is hereby incorporated by reference. U.S. patent application Ser. No. 08/738,858 provides a detailed description of the flashlight body 20 and the head assembly 30 shown in the flashlight of the present invention. Of course, the present invention is in no way limited to the flashlight body and head assembly shown therein and may be adapted for use with any flashlight and head assembly.

Figure 2:
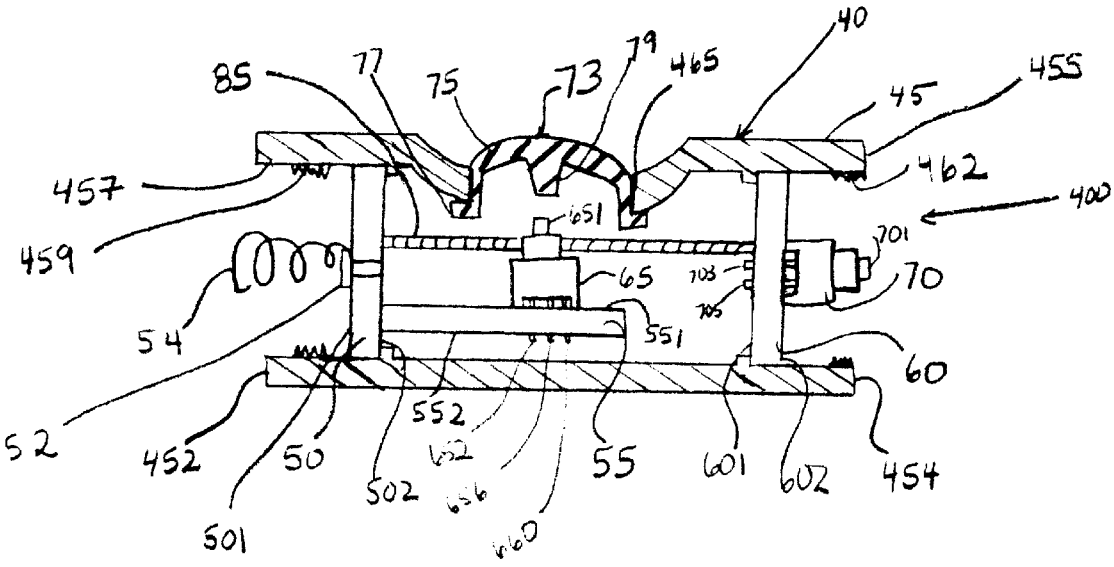
FIG. 2 is cross-sectional view of the endcap of the flashlight shown in FIG. 1, depicting the switch assembly contained therein.
Figure 3:
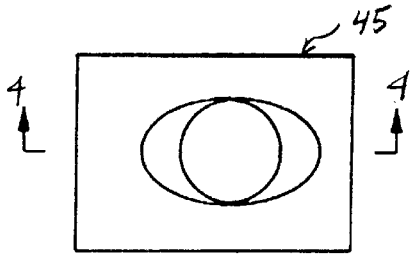
FIG. 3 is a top view of the endcap of the flashlight shown in FIG. 1.
Figure 4:
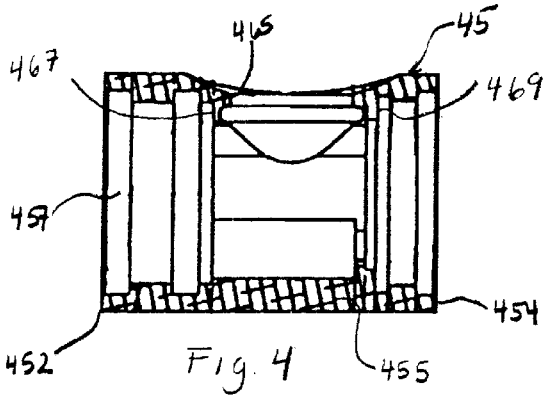
FIG. 4 is a cross-sectional view of the endcap taken along line 4—4 of FIG. 3.
Figure 5:
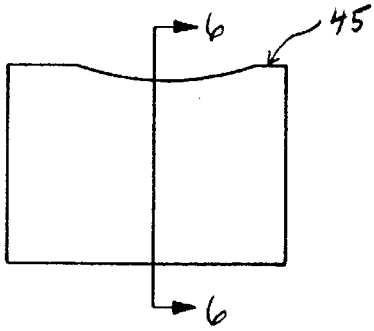
FIG. 5 is a side view of the endcap of FIG. 3.
Figure 6:
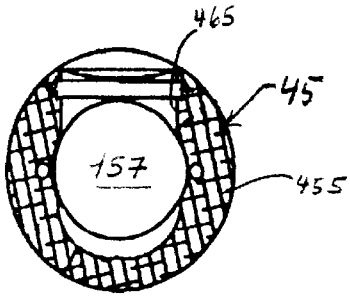
FIG. 6 is a cross-sectional view of the endcap taken along line 6—6 of FIG. 5.
Figure 7:
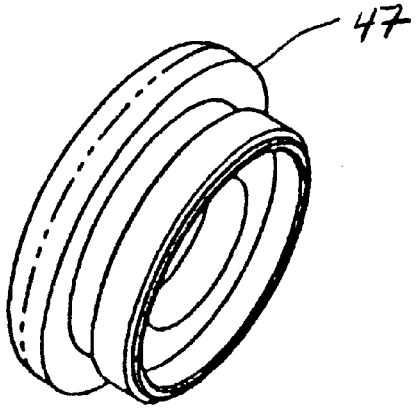
FIG. 7 is a perspective view of the endcap closure of the flashlight shown in FIG. 1.

The switch assembly 40 is depicted in further detail in FIGS. 2–14. As can be seen in FIGS. 2 and 4, the switch assembly 40 includes an endcap 45 having a first end 452, a second end 454, a sidewall 455, and an axial bore 457 extending therethrough, between the first and the second end. The axial bore 457 is provided with internal threading 459 adjacent the first end 452 and internal threading 462 adjacent the second end 454. The internal threading 459 is intended to mate with threading provided on the flashlight body 20 while the internal threading 462 is to mate with threading provided on an endcap closure 47 (shown in FIG. 7). The endcap 45 further includes a countersunk radial bore 465 that accommodates a switch cover, as will be described later in detail. As can be seen in FIG. 4, endcap 45 is provided with a number of internal shoulders, including shoulders 467 and 469 against which circuit board 50 and circuit board 60 respectively abut. Both the endcap 45 and the closure 47 are preferably made of aluminum.

Disposed within endcap 45 is a switch circuit assembly 400 which comprises a first circuit board 50, a second circuit board 55 and a third circuit board 60. The second circuit board 55 is provided with push button switch 65, the circuit board 55 and the switch 65 both being electrically connected with the first circuit board 50. The third circuit board 60 is provided with push button switch 70, the third circuit board 60 and the switch 70 both being electrically connected with the first circuit board 50.

First circuit board 50 has a first side 501 and a second side 502. As can be seen from FIGS. 9 and 10, the first circuit board 50 is provided with a plurality of through holes that extend between first side 501 and second side 502, namely a central hole 504, two conductive fastener holes 506, 508, two through holes 511, 513, and a slot 516. Each of the holes 504–516 is provided with conductive material along its length, so as to provide an electrically conductive pathway from first side 501 to second side 502. Threaded inserts (not shown) are provided in holes 506, 508. These inserts, along with the conductive fasteners 85 that will be discussed below, provide the interconnection between circuit board 50 and circuit board 60.

Figure 9:
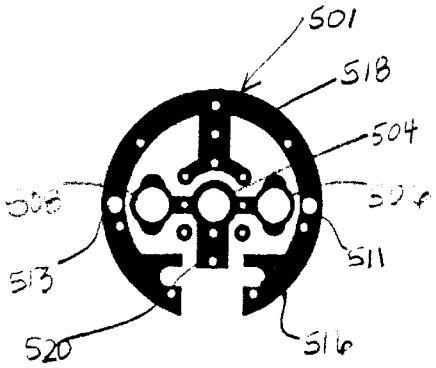
FIG. 9 is a front axial view of the first circuit board of the present invention.

As shown in FIG. 9, first side 501 is provided with a first conductive trace 518 and a second conductive trace 520. First conductive trace 518 electrically interconnects the through holes 511, 513 with the slot 516. Second conductive trace 520 electrically interconnects the central hole 504 and the conductive fastener holes 506, 508.

Figure 10:
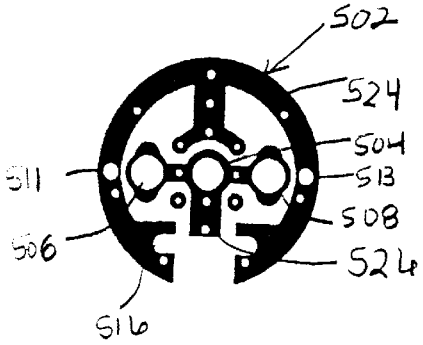
FIG. 10 is a rear axial view of the first circuit board of the present invention.

The second side 502 is provided with the same trace pattern as the first side 501. As can be seen in FIG. 10, the second side 502 includes a third conductive trace 524 and a fourth conductive trace 526. Third conductive trace 524 electrically interconnects the through holes 511, 513 with the slot 516. Fourth conductive trace 526 electrically interconnects the central hole 504 and the conductive fastener holes 506, 508. Through holes 511, 513 are electrically conductive such that the first conductive trace 518 and the third conductive trace 524 are in electrical contact.

Referring back to FIG. 2, an electrically conductive eyelet 52 is fitted into central hole 504 of the first circuit board 50, and preferably soldered into place, so that eyelet 52 is in good electrical contact with conductive traces 520 and 526. Eyelet 52 is connected to spring 54, so that spring 54 is also electrically connected to conductive traces 520 and 526. Spring 54 is adapted for contact with the negative terminal of a battery (not shown).

Figure 11:
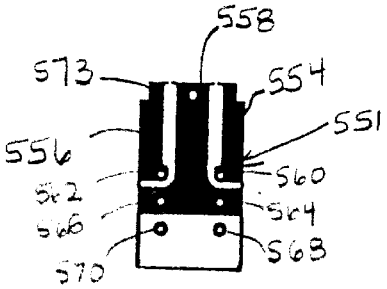
FIG. 11 is a plan view of the second circuit board of the present invention.

The second circuit board 55, which has a first side 551 and a second side 552, is similarly provided with a number of conductive traces. As can be seen in FIG. 11, the first side 551 of board 55 has a first conductive trace 554, a second conductive trace 556, and a third conductive trace 558. Board 55 also has electrically conductive pin holes 560–570 that are aligned about the major axis of board 55. Pin hole 560 is in electrical contact with first trace 554, pin hole 562 is in electrical contact with second trace 556, and pin holes 564, 566 are in electrical contact with third trace 558.

Those skilled in the art will understand that the second side 552 (not shown in FIG. 11) of board 55 may be similarly configured as first side 551 to aid in the assembly of the switch circuit assembly 400. Board 55 further defines a tab 573, which is disposed to seat in slot 516 of first board 50 to permit the first board 50 to be joined to the second board 55. When first board 50 is joined with second board 55, the third conductive trace 524 of the first board 50 is in electrical contact with the first and the second traces 554, 556 of the second board 55, and the fourth trace 526 of the first board 50 is in electrical contact with the third trace 558 of the second board 55.

Referring back to FIG. 2, switch 65 is carried by second board 55. Switch 65 is of the push-button type that is commercially available from E-Switch, Brooklyn Park, Minn. A suitable type is Model TL-2201 OA, which is a DPDT momentary contact switch. It is typically characterized by very quiet operation due to its size and construction. Switch 65 is provided with an actuator 651, preferably in the form of a plunger, and six electrical attachment pins 652–662 (only pins 652, 656, and 660 are depicted). The pins are disposed for receipt, preferably by soldering, into holes 560–570 of second board 55. In the preferred embodiment, switch 65 is a deadman switch or an intermittent switch. With an intermittent switch, electrical contact is maintained only when the actuator 651 is depressed and manually held down by the user.

When switch 65 is attached to board 55, plunger 651 can be manipulated to establish electrical contact between the first, second, and third conductive traces of the second board 55. Specifically, when plunger 651 is depressed, an electrical circuit is established between the first, second, and third conductive traces of the second board 55. As a result, an electrical current applied to spring 54 from the negative terminal of the battery passes through eyelet 52, to second trace 520 of the first board 50, to fourth trace 526 of the first board 50, to the third trace 558 of the second board 55, to switch 65 via switch attachment pins, out of switch 65 via switch attachment pins, to first and second traces 554, 556 of the second board 55, and to the third trace 524 of the first board 50. Furthermore, since through holes 511, 513 establish electrical contact between the third trace 524 and the first trace 518 of the first board 50, first trace 518 is also included in the circuit. Because the outer periphery of traces 518 and 524 abut against endcap 45, the electric circuit is established through the metal sidewall 455 of the endcap 45, along the flashlight body 20, and ultimately to one of the light bulb connections in the head assembly 30.

Switch assembly 40 is further provided with switch cover 73, which protects the switch 65 from moisture and debris. Switch cover 73 is integrally formed of a bowl shaped section 75, an o-ring 77 disposed about the open end of bowl shaped section 75 and axially aligned therewith. Switch cover 73 may be formed of any flexible electrically insulating material, such as, for example, rubber. The switch cover 73 is disposed within bore 465 and above plunger 651 of switch 65, such that stem 79 is axially aligned above plunger 651. Stem 79 functions both to provide support to bowl section 75 and to engage plunger 651 when switch cover 73 is depressed. Thus, switch 65 may be operated by applying pressure through switch cover 73.

The switch circuit assembly 400 further includes a third switch circuit board 60. The third switch circuit board 60 has a first side 601 and a second side 602. As can be seen from FIGS. 12 and 13, the third board 60 is provided with a plurality of through holes that extend between first side 601 and second side 602, namely a central hole 604, six switch mounting holes 606–611, two conductive fastener holes 613, 615, and four additional holes 618–624 whose function will be described below. Each of the holes 604–624 is provided with conductive material along its length, so as to provide an electrically conductive pathway from first side 601 to second side 602.

Figure 12:
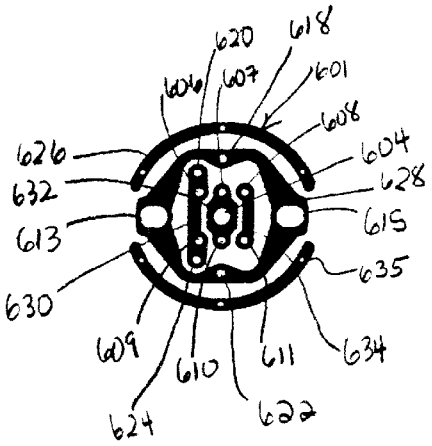
FIG. 12 is a front axial view of the third circuit board of the present invention.

As shown in FIG. 12, first side 601 is provided with a first conductive trace 626, a second conductive trace 628, a third conductive trace 630, a fourth conductive trace 632, a fifth conductive trace 634, and a sixth conductive trace 635. First and sixth conductive traces 626 and 635 are provided along the periphery of the board 60. Second conductive trace 628 electrically interconnects the conductive fastener holes 613, 615 and additional holes 618 and 622. Third conductive trace 630 electrically interconnects switch mounting holes 606 and 609, and additional holes 620 and 624. Fourth conductive trace 632 electrically interconnects switch mounting holes 607 and 610, and the central hole 604. Fifth conductive trace 634 electrically interconnects switch mounting holes 608 and 611.

Figure 13:
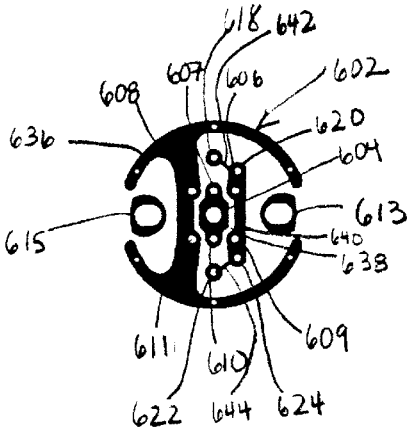
FIG. 13 is a rear axial view of the third circuit board.

As shown in FIG. 13, second side 602 is provided with a seventh conductive trace 636, an eighth conductive trace 638, and a ninth conductive trace 640. Seventh conductive trace 636 is provided along the periphery of the board 60 and electrically interconnects switch mounting holes 608 and 611. Eighth conductive trace 638 electrically interconnects switch mounting holes 607 and 610, and the central hole 604. Ninth conductive trace 640 electrically interconnects switch mounting holes 606 and 609, and additional holes 620 and 624.

Wire jumpers 642, 644 are provided between additional holes 618 and 620, and between additional holes 622 and 624. The function of these jumpers is to electrically interconnect second trace 628 with third trace 630, and then interconnect the third trace 630 with the ninth trace 640.

As seen in FIGS. 12 and 13, a number of holes (not labelled) are provided along the periphery of both sides 601 and 602, on traces 626 and 636. These holes are plated through and function to electrically interconnect traces 626 and 636.

To structurally and electrically interconnect the third board 60 to the first board 50, the assembly is provided with a set of conductive fasteners 85. Referring back to FIG. 2, the fasteners 85 extend from the first board 50 to the third board 60. The threaded fasteners 85 extend through the inserts of holes 506 and 508 of first board 50 and holes 613 and 615 of third board 60. These fasteners 85 along with the inserts of holes 506 and 508 provide the connection between first board 50 and third board 60.

As can be seen in FIG. 2, switch 70 is mounted on second side 602 of third board 60. Switch 70 is of the push-button type that is commercially available from E-Switch, Brooklyn Park, Minn. A suitable type is Model TL-2203, which is a DPDT latching contact switch. It is typically characterized by very quiet operation due to its size and construction. Switch 70 is provided with an actuator 701, preferably in the form of a plunger, six electrical attachment pins 703–713 (only pins 703 and 705 are depicted), and a normally open pair of contacts. Pins are disposed for receipt, preferably by soldering, into holes 606–611 of third board 60. In the preferred embodiment, switch 70 is an on/off switch. To operate such a switch, the actuator is depressed to close the circuit and place the lamp in its "on" position. The actuator is then depressed again to open the circuit and place the lamp in its "off" position.

Figure 8:
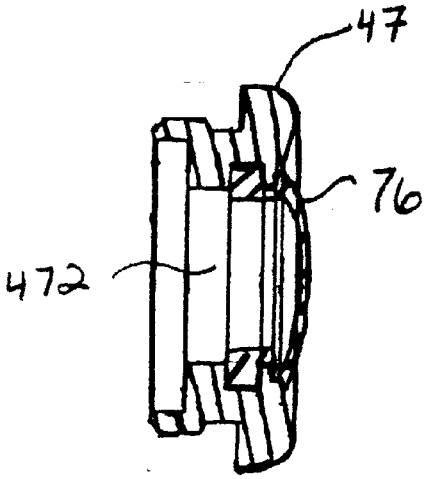
FIG. 8 is a cross-sectional view of the endcap closure of FIG. 7.

As can be seen in FIG. 8, the endcap closure 47 is provided with an axial bore 472 and a switch cover 76, which protects switch 70 from moisture and debris. Switch cover 76 is made of a flexible electrically insulating material, such as rubber. The switch cover 76 is disposed within bore 472 and then the closure is threaded onto the second end 454 of the endcap 45. The switch cover 76 is thus positioned adjacent to the actuator 701 of switch 70. When the cover 76 is depressed, it can, in turn, depress the actuator 701 and actuate the switch 70.

When switch 70 is attached to board 60, plunger 701 can be manipulated to establish electrical contact between the seventh, eighth, and ninth conductive traces of the third board 60. Specifically, when plunger 701 is depressed, an electrical circuit is established between the seventh, eighth, and ninth conductive traces of the third board 60. As a result, an electrical current applied to spring 54 from the negative terminal of the battery passes through eyelet 52, into second trace 520 of the first board 50, into fourth trace 526 of the first board 50, through the conductive fasteners 85, into the second trace 628 of the third board 60, through holes 618 and 622 and jumpers 642, 644, into ninth trace 640, into switch 70 via switch attachment pins, out of switch 70 via switch attachment pins, and into seventh and eighth traces 636, 638 of the third board 60. Traces 626 and 636 connect the metal sidewall 455 of the endcap 45 to the normally open pair of contacts of switch 70. The plunger 701 of switch 70 connects traces 626 and 636 via conductive fasteners 85 and spring 54 to the negative terminal of the battery. Because the outer periphery of traces 626 and 636 abut against endcap 45, the electric circuit is established through the metal sidewall 455 of the endcap 45, along the flashlight body 20, and ultimately to one of the light bulb connections in the head assembly 30.

Figure 14:
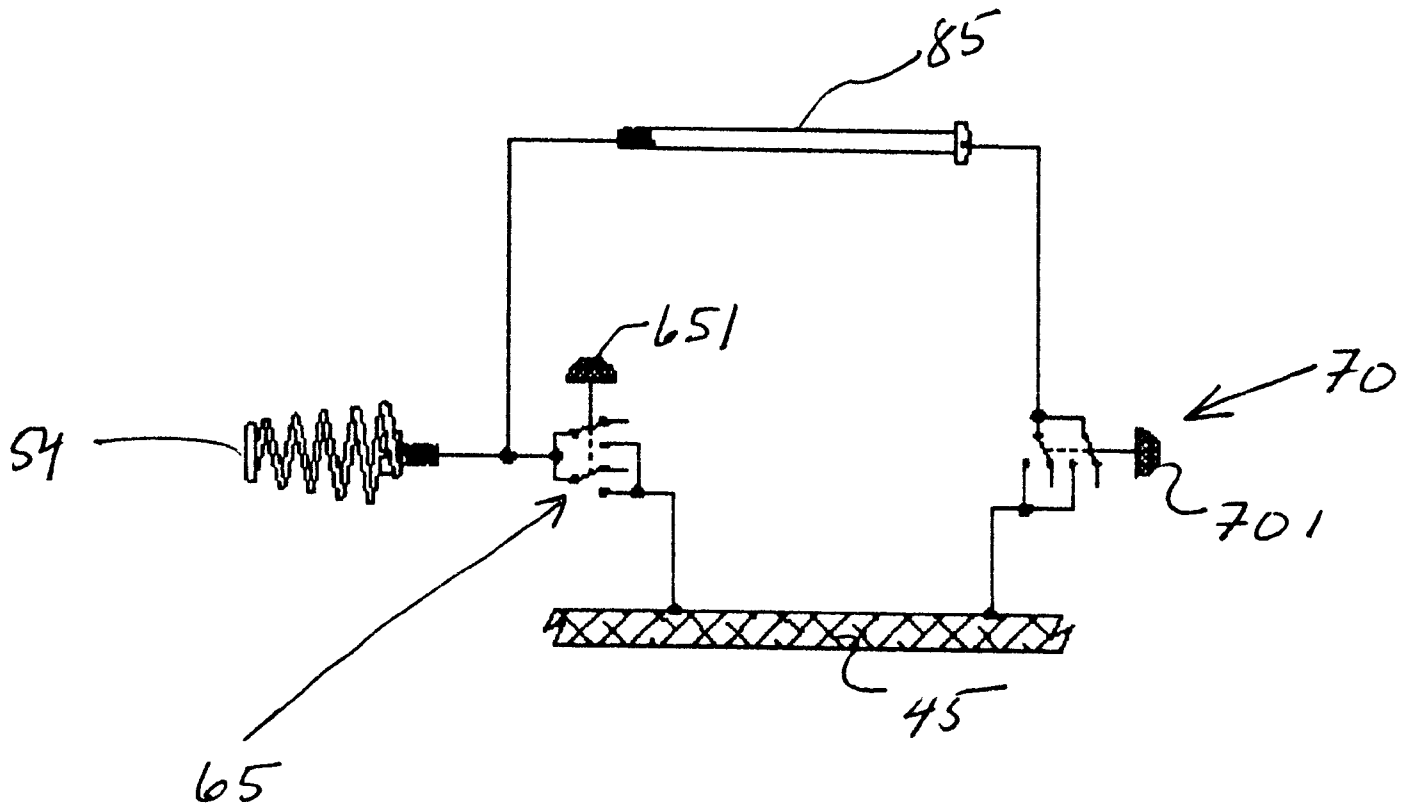
FIG. 14 depicts part of the electrical circuit of the present invention.
Figure 1:
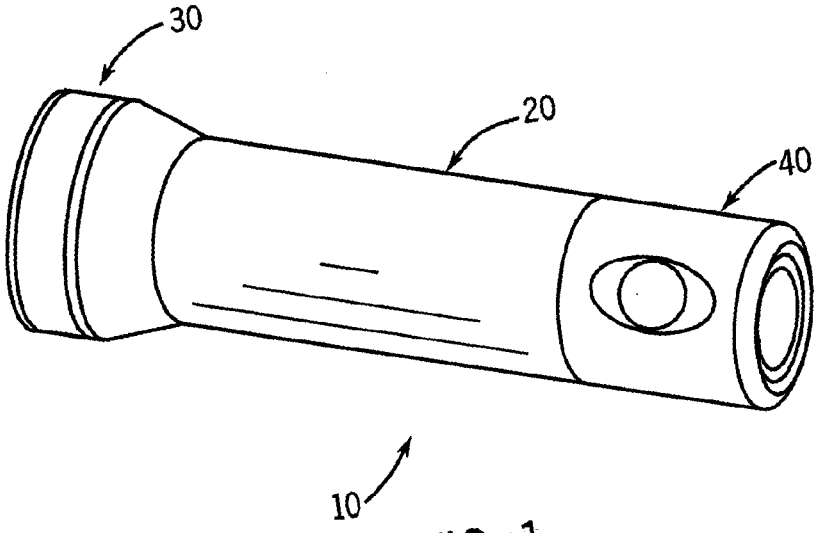
Figure 2:
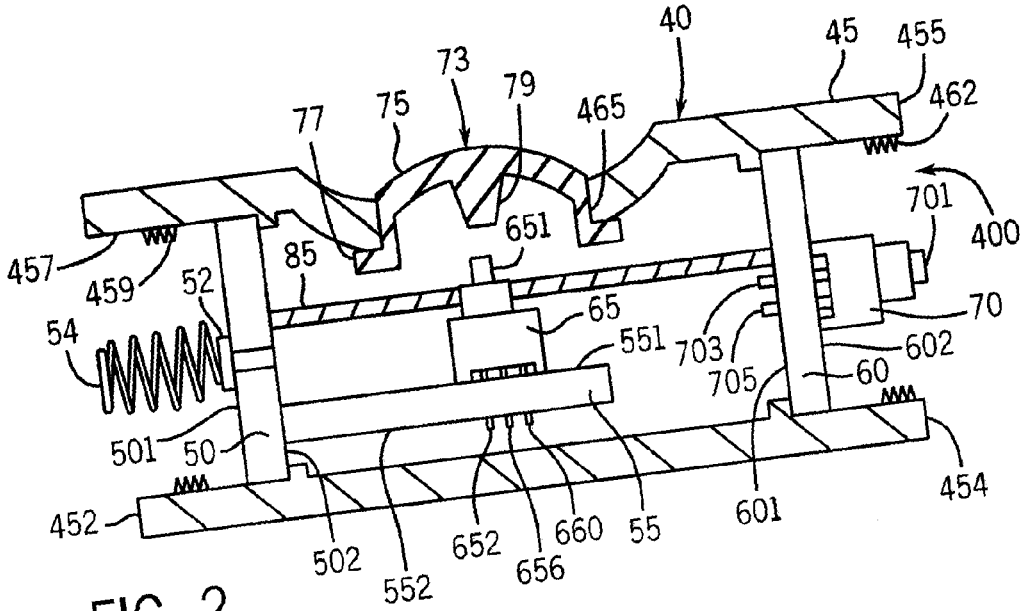
Figure 3:
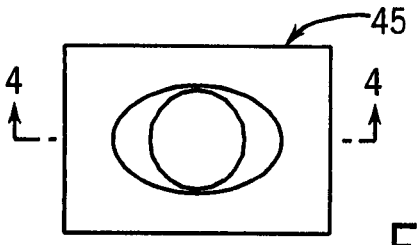
Figure 4:
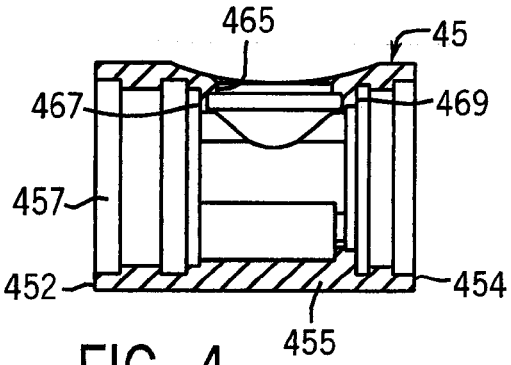
Figure 5:
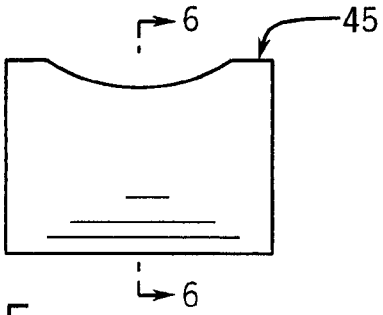
Figure 6:
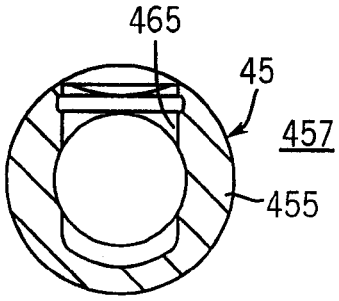
Figure 7:
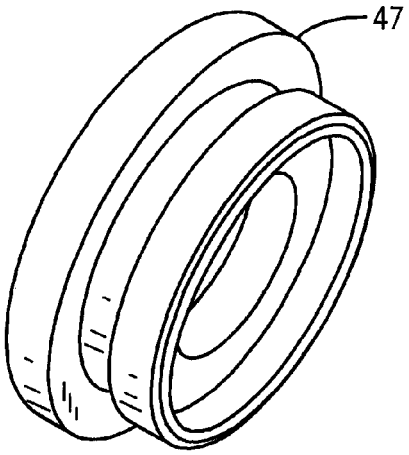
Figure 8:
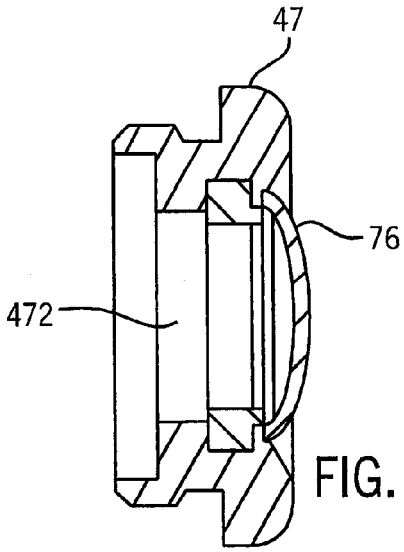
Figure 9:
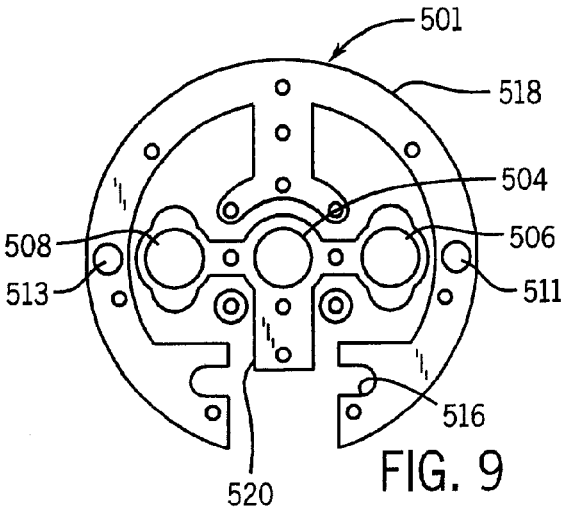
Figure 10:
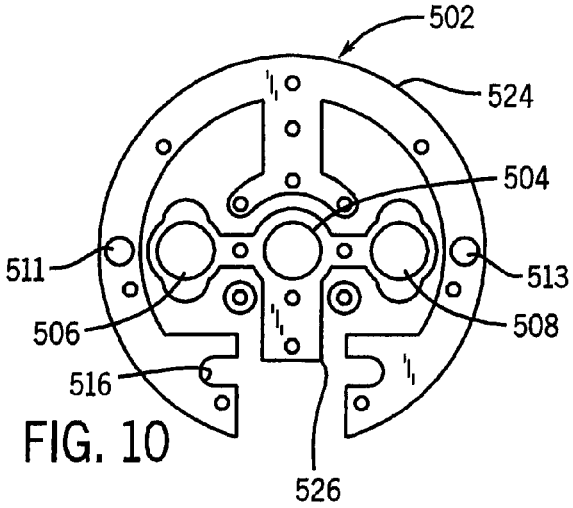
Figure 11:
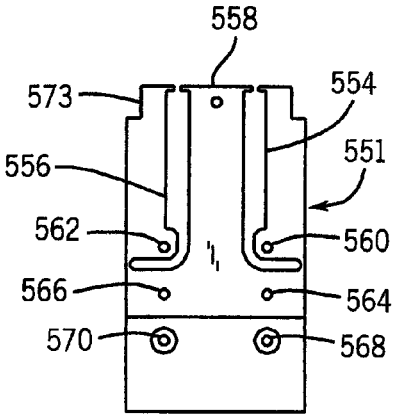
Figure 12:
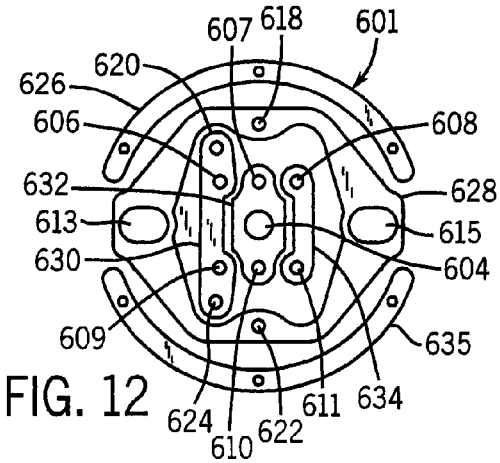
Figure 13:
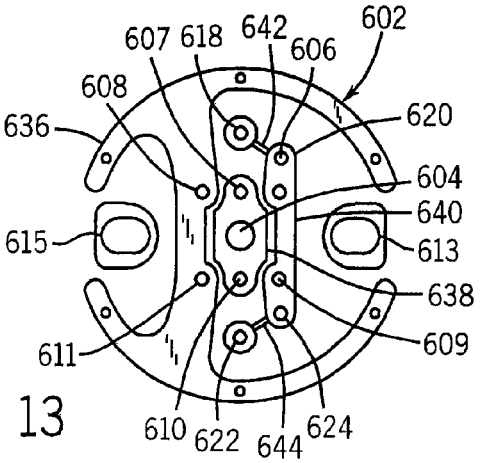
Figure 14:
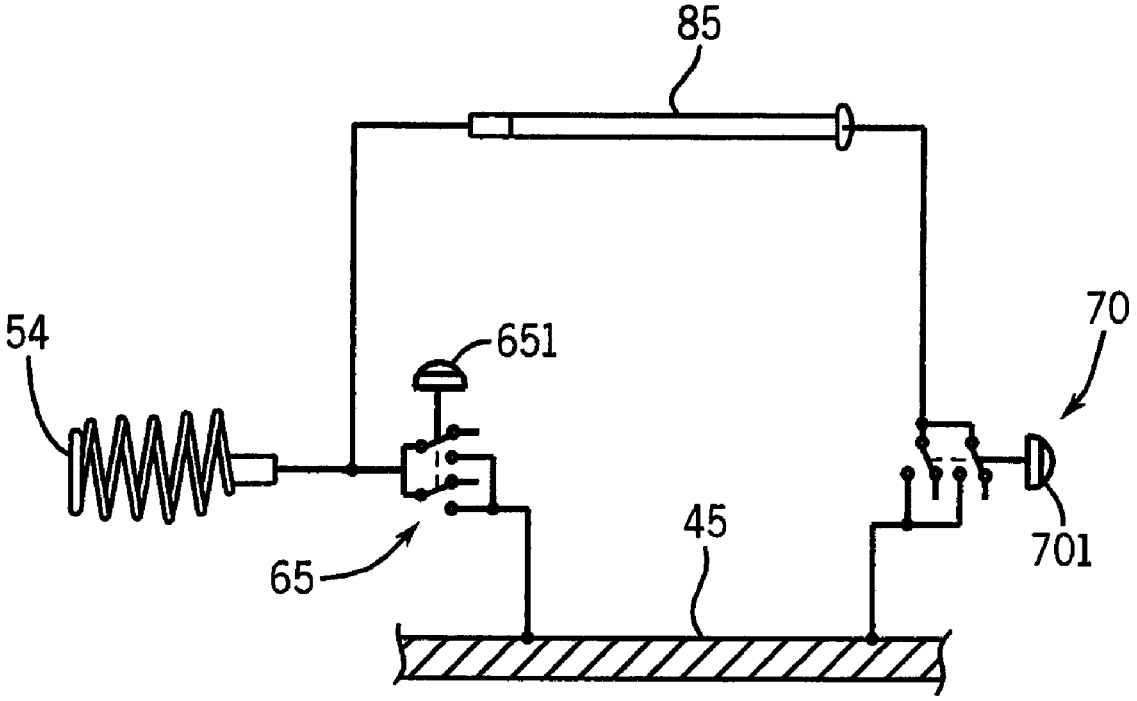

For the electrical circuit up to the point where the spring 54 abuts against the battery, reference should be made to U.S. patent application Ser. No. 08/738,858, previously incorporated by reference. The remainder of the circuit is depicted in FIG. 14. When the plunger of switch 65 is depressed, the electric circuit is completed and electric current flows from the spring 54, through the switch 65 and into the sidewall 45. Alternately, when the plunger of switch 70 is depressed, the electric circuit is completed and electric current flows from the spring 54, through the fastener 85 and the switch 70 and into the sidewall 45.

As is apparent, one advantage to the present invention is that the two switches are independent of one another. Thus, when switch 70 is in its off position, intermittent switch 65 can be used. Similarly, when switch 65 is in its normal off position, switch 70 can be used to place the lamp in the on position. The use of switch 65 does not interfere with the use of switch 70 and vice versa. When switch 70 is in its on position, the actuation of switch 65 is redundant and the lamp remains in the on position. When switch 65 is in its on position, actuating switch 70 is redundant and does not operate to place the lamp in its off position.

Another advantage to the present invention is the interchangeability of the switches. In the embodiment discussed above, the on/off switch was provided in the rear of the flashlight while the intermittent switch was provided on the side of the flashlight. Due to customer preference, there may be a need to exchange the location of these two switches. Thus, in an alternate embodiment, the on/off switch may be provided on the side of the flashlight while the intermittent switch is provided in the rear of the flashlight. This alternate embodiment would require placing an intermittent switch on board 60 and an on/off switch on board 55. From a manufacturer's perspective, such an alternate embodiment is simply a matter of selecting a different switch and requires no design modifications to the circuit boards. Consequently, providing on/off or intermittent switches at the side or end of the flashlight is a matter of switch selection and does not require any modification or redesign of the circuit boards. Thus, the flashlight can be customized according to the customer's needs.

While the invention has been described in connection with certain embodiments, it should be understood that it is not intended to limit the invention to these particular embodiments. To the contrary, it is intended to cover all alternatives, modifications and equivalents falling within the spirit and scope of the invention.

What is claimed is:

1. A flashlight comprising:

a flashlight body having a first end and a second end;

a head assembly operatively coupled to the first end of the flashlight body and including a lamp;

an endcap removably coupled to the second end of the flashlight body and having a peripheral side wall and a bore defined within said end cap;

first and second switches disposed within the bore in the end cap;

said end cap having a first end adapted for mating with the second end of the flashlight body, and having a second end provided with a closure;

one of said first and second switches comprising a latching ON/OFF switch that can be activated to open or close an electrical circuit including the lamp in response to actuation of a first switch actuator, and the other of said first and second switches comprising an intermittent switch operative to intermittently close an electrical circuit including the lamp only when activated in response to actuation of a second switch actuator, a selected one of said first and second switch actuators being exposed outwardly of the peripheral wall of said end cap, the other of said first and second switch actuators being exposed outwardly of said end closure, whereby said lamp can be continuously connected in electrical circuit in response to actuation of said first switch actuator or can be intermittently connected in electrical circuit in response to intermittent actuation of said second switch actuator.

2. The flashlight as defined in claim 1 wherein the end cap includes a radial bore, the bore being provided with a first flexible membrane cover which may be moved selectively into contact with said selected one of said first and second switches.

3. The flashlight as defined in claim 1 wherein the closure is provided with a second flexible membrane cover which may be moved selectively into contact with the other of said first and second switches.

4. A flashlight comprising:

a flashlight body having a first end and a second end;

a head assembly operatively coupled to the first end of the flashlight body, the head assembly including a lamp;

an endcap removably coupled to the second end of the flashlight body, the endcap accommodating a first printed circuit board, a second printed circuit board adapted to receive a first switch, and a third printed circuit board, orthogonally disposed with respect to the second printed circuit board, adapted to receive a second switch.

5. The flashlight of claim 4 further comprising a first switch mounted directly on the second printed circuit board, the second printed circuit board being electrically interconnected with the first printed circuit board.

6. The flashlight of claim 5 wherein the second printed circuit board is mounted on the first circuit board.

7. The flashlight of claim 4 further comprising a second switch mounted directly on the third printed circuit board, the third printed circuit board being electrically interconnected with the first printed circuit board.

8. The flashlight of claim 7 wherein the third board is electrically interconnected to the first board by at least one conductive fastener extending from the first board to the third board.

9. The flashlight of claim 4 wherein the first circuit board and the third circuit board are parallel with one other.

10. The flashlight of claim 4 wherein the first circuit board is positioned radially in the endcap.

11. The flashlight of claim 10 wherein the second circuit board is positioned perpendicular to the first circuit board.

12. The flashlight of claim 4 wherein the third circuit board is positioned radially within the endcap.

13. An end cap for use with a flashlight having a generally tubular flashlight body and a head assembly operatively coupled to the flashlight body, the head assembly including a lamp, said end cap being adapted for removable coupling to the flashlight body and having a outer peripheral surface and an end closure, and first and second discrete switches generally orthogonally disposed in the end cap, the first switch being a latching ON/OFF switch and the second switch being an intermittent switch, a selected one of said first and second switches being operatively associated with a switch actuator exposed for actuation from externally of the outer peripheral surface of said end cap, and the other of said first and second switches being operatively associated with a switch actuator exposed for actuation from externally of said end closure.

14. The endcap of claim 13 further comprising a first printed circuit board that is electrically interconnected with the first switch.

15. The endcap of claim 14 wherein the first printed circuit board is provided with a conductive element adapted for electrically connecting the first and second switches to a power source.

16. The endcap of claim 14 further comprising a second printed circuit board, the first switch mounted directly on the second printed circuit board, the second board being electrically interconnected with the first printed circuit board.

17. The endcap of claim 16 wherein the second printed circuit board is mounted on the first circuit board.

18. The endcap of claim 14 further comprising a third printed circuit board, the second switch mounted directly on the third printed circuit board, the third board being electrically interconnected with the first printed circuit board.

19. The endcap of claim 18 wherein the third printed circuit board is electrically interconnected to the first board by at least one conductive fastener extending from the first board to the third board.

20. The endcap of claim 13 further comprising a first printed circuit board and a second circuit board, the second circuit board adapted to receive either the first switch or the second switch.

21. The endcap of claim 20 further comprising a third printed circuit board adapted to receive either the first switch or the second switch.

* * * * *

UNITED STATES PATENT AND TRADEMARK OFFICE

CERTIFICATE OF CORRECTION

PATENT NO. : 6,474,833 B1
DATED : November 5, 2002
INVENTOR(S) : Parsons et al

It is certified that error appears in the above-identified patent and that said Letters Patent is hereby corrected as shown below:

The title page showing the illustrative figure should be deleted to be replaced with the attached title page.

Drawing sheets, consisting of Figs. 1-6, should be deleted to be replaced with the drawing sheets, consisting of Figs. 1-6, as shown on the attached page.

Signed and Sealed this

Thirteenth Day of July, 2004

JON W. DUDAS
*Acting Director of the United States Patent and Trademark Office*

(12) United States Patent
Parsons et al.

(10) Patent No.: US 6,474,833 B1
(45) Date of Patent: Nov. 5, 2002

(54) DUAL SWITCH FLASHLIGHT

(75) Inventors: Kevin L. Parsons, Appleton, WI (US); W. Clay Reeves, Dallas, TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 09/513,731

(22) Filed: Feb. 14, 2000

(51) Int. Cl.[7] ..... F21L 4/04

(52) U.S. Cl. ..... 362/205; 362/206; 362/802; 200/60

(58) Field of Search ..... 362/205, 206, 362/802; 200/60, 51 LM, 332.02

(56) References Cited

U.S. PATENT DOCUMENTS 4,823,242 A 4/1989 Maglica et al.
5,138,538 A * 8/1992 Sperling ..... 362/205
6,045,237 A * 4/2000 Parsons et al. ..... 362/205

* cited by examiner

*Primary Examiner*—Sandra O'Shea
*Assistant Examiner*—Guiyoung Lee
(74) *Attorney, Agent, or Firm*—Welsh & Katz, Ltd.

(57) ABSTRACT

The present invention provides a flashlight having two switches, an on-off switch and an intermittent switch. The on-off switch allows the flashlight to be placed in either the on position or the off position. The intermittent switch allows the flashlight to be in the on position only when the switch is depressed and manually held down by the user. The presence of both switches provides the user with the flexibility of using the flashlight in either the on/off mode or the intermittent mode.

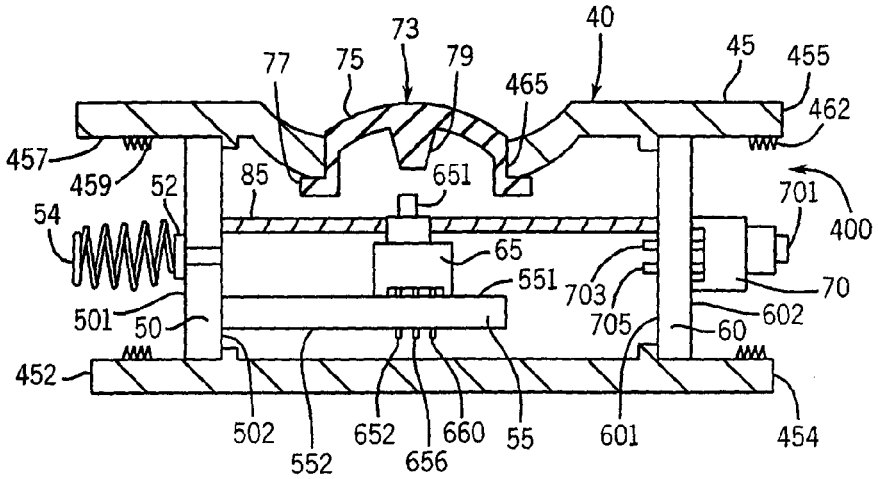

21 Claims, 6 Drawing Sheets